United States Patent [19]

Hyogo et al.

[11] Patent Number: 4,940,417

[45] Date of Patent: Jul. 10, 1990

[54] CONNECTOR DEVICE WITH FITTING ADJUSTMENT MECHANISM

[75] Inventors: Yukihiro Hyogo; Akio Kurihara, both of Shizuoka, Japan

[73] Assignee: Yazaki Corporation, Japan

[21] Appl. No.: 370,887

[22] Filed: Jun. 23, 1989

[30] Foreign Application Priority Data

Jun. 24, 1988 [JP] Japan ..... 63-83008[U]

[51] Int. Cl.[5] ..... H01R 13/631

[52] U.S. Cl. ..... 439/248

[58] Field of Search ..... 439/246–248, 439/252

[56] References Cited

U.S. PATENT DOCUMENTS 2,882,510 4/1959 Colvin ..... 439/248

4,780,090 10/1988 Sugiyama et al. ..... 439/247

FOREIGN PATENT DOCUMENTS 57-145284 9/1982 Japan .

61-6281 1/1986 Japan .

*Primary Examiner*—Gary F. Paumen

*Attorney, Agent, or Firm*—Wigman & Cohen

[57] ABSTRACT

A connector with a fitting adjustment mechanism includes a female or a male connector fitted to a mating connector, a first frame which surrounds the connector and a second frame which surrounds the first frame. The connector has a first mechanism for enabling step-by-step displacement of the connector with respect to the first frame along an X or Y direction within a plane substantially perpendicular to the fitting direction of the connectors, and a second mechanism for enabling step-by-step displacement of the first frame with respect to the second frame along the direction perpendicular to the displaceable direction of the connector.

The first mechanism has protrusions on each of the opposite surfaces of the connector and a plurality of recesses provided on each of the opposite inner surfaces of the first frame with which the protrusions are engaged. The second mechanism also has protrusions on each of the outer opposite surfaces of the first frame and a plurality of recesses with which the protrusions are engaged provided on the inner surfaces of the second frame.

9 Claims, 3 Drawing Sheets

CONNECTOR DEVICE WITH FITTING ADJUSTMENT MECHANISM

BACKGROUND OF THE INVENTION

1. Field of the Invention

The present invention relates to a connector device with a fitting adjustment mechanism, and in particular to a connector device including one of a female and a male connectors to be fitted together in order to accomplish electrical connection therebetween, in which a fitting adjustment mechanism for adjusting positional deviation between the female and male connectors when these connectors are fitted together is provided on the female or male connector.

2. Description of the Prior Art

One of the known connector devices with a fitting adjustment mechanism for adjusting positional deviation between a female and a male connector when these connectors are fitted together is disclosed in Japanese Laid Open Patent Publication No. 57-145284.

The known connector device comprises a female and a male connector to be fitted together, and a fitting adjustment mechanism. The fitting adjustment mechanism of the known connector device comprises a pair of first bellows-like leaf springs attached at one end thereof to the female connector so as to allow displacement of the female connector along the X direction in a plane and a pair of second bellows-like leaf springs attached at one end thereof to the male connector so as to allow displacement of the male connector along the Y direction perpendicular to the X direction within the same plane. The first and second bellows-like leaf springs are at the other ends attached to different parts, respectively. Therefore, in accordance with this connector device, a positional deviation between the female and male connectors when these connectors are fitted can be absorbed by elastic deformation of the leaf springs of the fitting adjustment mechanism.

The known connector device has an advantage that the positional deviation between the female and male connectors can be corrected with ease. On the other hand, however, in the known connector device with a fitting adjustment mechanism, there are disadvantages such as follows:

(1) Since the leaf springs have to be attached to each of the connectors, respectively, it was difficult to manufacture the connector device.

(2) Since both connectors are elastically supported by the leaf springs, the connectors swing relative to one another when they are fitted, thus leading to difficulty of the fitting operation of the connectors. Further, since the connectors may still swing after the connectors are fitted together, the electrical connection between the connectors may deteriorate due to looseness of the fitting state between the connectors.

SUMMARY OF THE INVENTION

In view of the disadvantages of the known connector device as described above, a main object of the present invention is to provide a connector device with a fitting adjustment mechanism in which the fitting adjustment mechanism can be provided on only one of a male and a female connectors.

Another object of the present invention is to provide a connector device with a fitting adjustment mechanism which enables the maintenance of a stable posture of the female and male connectors after the connectors are fitted together.

In order to accomplish these objects, a connector device with a fitting adjustment mechanism according to the present invention comprises a female or a male connector fitted to the other connector, a first frame for surrounding the connector, a second frame for surrounding the first frame, first means for enabling step-by-step displacement of the connector with respect to the first frame along X or Y direction within a plane substantially perpendicular to the fitting direction of the connectors, and means for enabling step-by-step displacement of the first frame with respect to the second frame along the direction perpendicular to the displaceable direction of the connector with respect to the first frame with the same plane.

In accordance with the present invention having the above structure, since the fitting adjustment mechanism is provided on one of female and male connectors, it is not necessary for the other connector to provide anything as a part of the fitting adjustment mechanism. This means that manufacture of the connector device becomes easy. Further, it is possible to use a normal type connector as a partner connector if it has the same size as that of the connector.

Further, since the connector of the connector device is constituted so as to be able to displace step-by-step along X and Y directions within a plane perpendicular to the fitting direction of the connectors and keep a stable posture at a position where positional adjustment is finished, fitting operation of the connectors becomes easy and there is no fear of looseness of the connectors.

The first means can be provided between the connector and the first frame and the second means is provided between the first frame and the second frame. The connector has a first and a second opposite outer peripheral surfaces, and each of the first and second frames has a substantially square shape having a first and a second opposite inner and outer peripheral surfaces, respectively.

In this case, the first means can be formed from at least one protrusion provided on each of the first opposite outer peripheral surfaces of the connector or each of the first opposite inner peripheral surfaces of the first frame which faces the first outer peripheral surface of the connector, and a plurality of recesses provided on, each of the first opposite inner surfaces of the first frame on each of the first opposite outer peripheral surfaces of the connector in such a manner that the at least one protrusion is engaged with one of the recesses. The second means can be formed from at least one protrusion provided on each of the second opposite outer surfaces of the first frame or each of the second opposite inner surfaces of the second frame which faces the second outer surface of the first frame, and a plurality of recesses provided on each of the second opposite inner surfaces of the second frame or each of the second opposite outer surfaces of the first frame in such a manner that the at least one protrusion is engaged with one of the recesses.

These and other objects of the present invention, as well as the details of the preferred embodiments, will be more fully understood when taken in conjunction with the following drawings.

DETAILED DESCRIPTION OF THE PREFERRED EMBODIMENT

Figure 1:
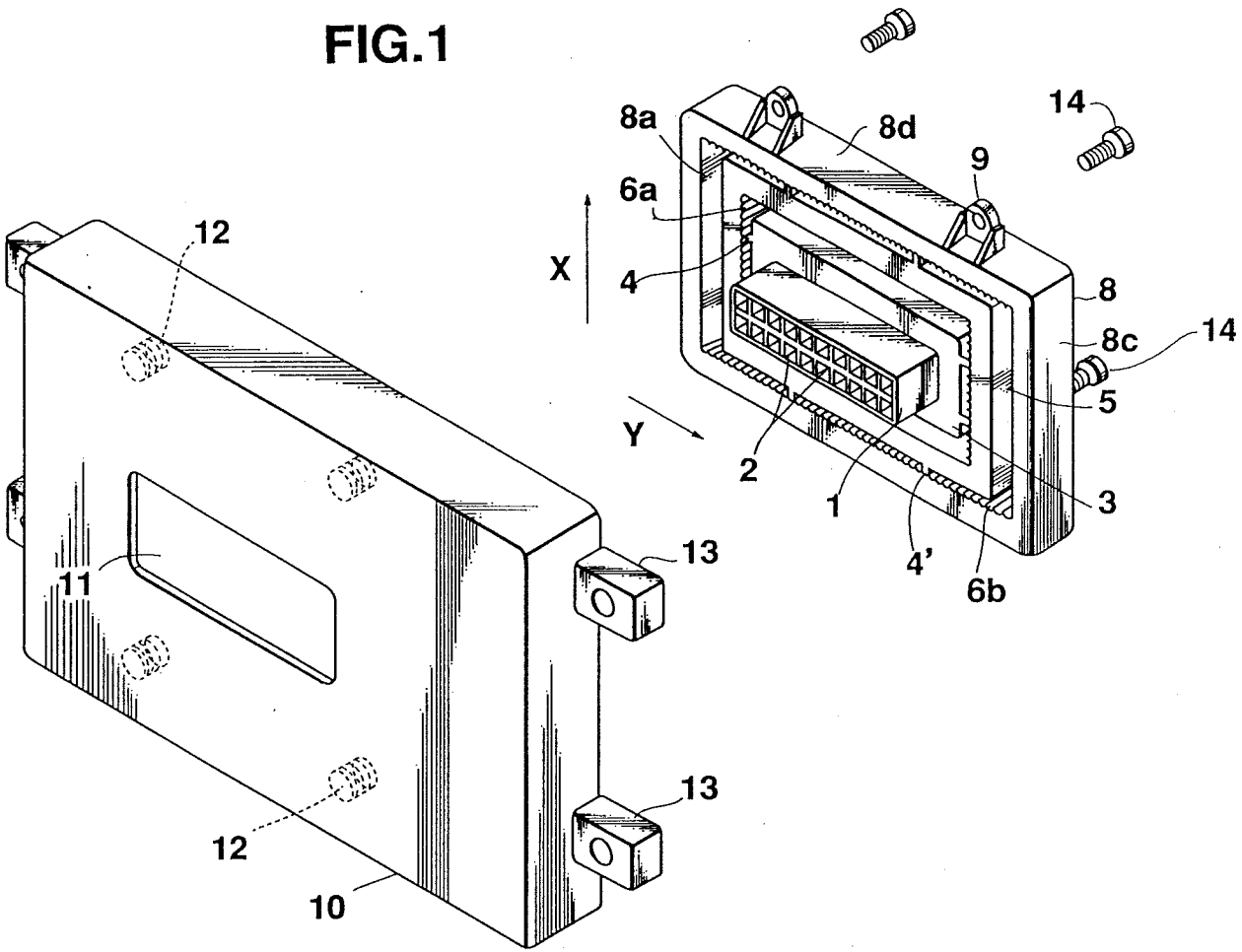
FIG. 1 is a perspective view of a connector device with fitting adjustment mechanism of an embodiment of the present invention.

Referring now to the drawings, a preferred embodiment of the present invention will be described.

Figure 2:
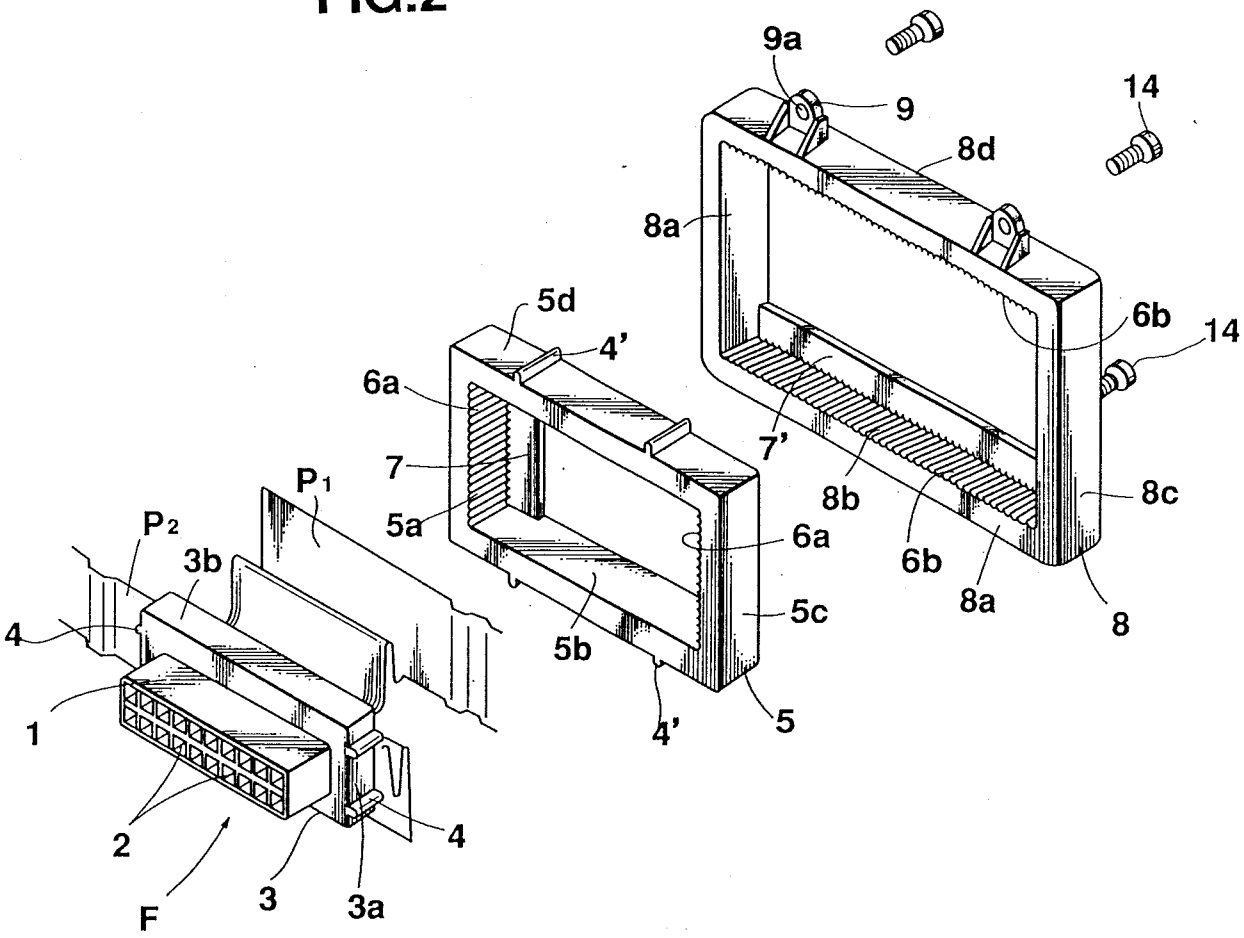
FIG. 2 is a disassembled perspective view of the connector device of the embodiment.

In FIGS. 1 and 2, a reference numeral 1 denotes a male connector having a rectangular shape in cross section. The male connector 1 has a front portion to be fitted to a partner connector and a rear portion. In the connector 1, there are formed a plurality of terminal accommodating compartments 2. In each of the terminal accommodating compartment 2, a female terminal (not shown) is accommodated. On the outer periphery of the rear portion of the male connector 1, there is provided a flange member 3 also having a substantially rectangular shape. The flange member 3 has two sets of opposite outer peripheral surfaces 3*a*, 3*a* and 3*b*, 3*b*. On each of the opposite outer peripheral surfaces 3*a*, 3*a*, there are provided two spaced protrusions 4 which are parallel with each other. Each of the protrusions 4 has a substantially semi-circular shape in cross section and extends over the width of the flange member 3 toward the fitting direction of the male connector 2 to the female connector 19. Flexible printed board P1 and P2 are connected to the female terminals of the male connector 1.

In the drawings, a reference numeral 5 is a first frame for surrounding the flange member 3. The first frame 5 has a substantially rectangular shape so as to define a rectangular space therein. The size of the rectangular space is relatively larger than that of the flange member 3, so that a ring-shaped space is formed between, the flange member and the first frame 5. The first frame 5 also has two set of opposite inner and outer peripheral surfaces 5*a*, 5*a* and 5*b*, 5*b*, and 5*c*, 5*c* and 5*d*, 5*d*. On each of the opposite inner surfaces 5*a*, 5*a* which face each of the opposite outer surfaces 3*a*, 3*a* of the flange member 3, respectively, there is formed a plurality of recesses 6*a*, 6*a*.

Each of the recesses 6*a*, 6*a* also extend over the width of the first frame 5 toward the fitting direction of the male connector 1 to the female connector. Further, the recess has a substantially semi-circular shape in cross section with which the protrusion 4 is engaged. Therefore, the flange member 3 in which the male connector 1 is provided can be supported to the first frame 5 by engagements of the protrusions 4 and the recesses 6*a*. In this case, the engagement between the protrusion 4 and the recess 6*a* is set such that the protrusion 4 can be displaced to an adjacent recess 5*a* step-by-step when a certain external force is exerted to the male connector 1.

On each of the opposite outer surfaces 5*d* and 5*d* of the first frame 5, which are located on the opposite side of the other opposite inner surfaces 5*b*, 5*b* thereof, there are provided two spaced protrusions 4' which are parallel with each other. Each of the protrusions 4' has a substantially semi-circular shape in cross section and extends over the width of the first frame 5 toward the fitting direction of the male connector 1 to the female connector.

Further, on the rear portion of the first frame 5, there is provided a stopper plate, 7 to which the flange member 3 is held when the first frame 5 and the flange member 3 are assembled.

In the drawings, a reference numeral 8 denotes a second frame for surrounding the first frame 5. The second frame 8 has a substantially rectangular shape so as to define a rectangular space therein. The size of the rectangular space of the second frame 8 is relatively larger than that of the first frame 5, so that a ring-shaped space is formed between the first and second frames 5 and 8. The second frame 8 also has two set of opposite inner and outer peripheral surfaces 8*a*, 8*a* and 8*b*, 8*b*, and 8*c*, 8*c* and 8*d*, 8*d*. On each of the opposite inner surfaces 8*b*, 8*b* which face each of the opposite outer surfaces 5*d*, 5*d* of the first frame 5, respectively, there is formed a plurality of recesses 6*b*.

Each of the recesses 6*b* also extend over the width of the second frame 8 toward the fitting direction of the male connector 1 to the female connector. Further, each of the recesses 6*b* has a substantially semi-circular shape in cross section with which the protrusion 4' provided on the first frame 5 is engaged. Therefore, the first frame 5 in which the flange member 3 and the connector 1 are supported can be supported to the second frame 8 by engagements of the protrusions 4' of the first frame 5 and the recesses 6*b* of the second frame 8. In this case, the engagement between the protrusion 4' and the recess 6*b* is set such that the protrusion 4' can be displaced to an adjacent recess 6*b* step-by-step when a certain external force is exerted to the male connector 1.

Further, on the rear portion of the second frame 8, there is provided a stopper plate 7' to which the first frame 5 is held when the first and second frames 5 and 8 are assembled. Furthermore, on each of the opposite outer surfaces 8*d*, 8*d*, there are provided two tabs 9 each having a screw hole, respectively.

In the drawings, a numeral 10 denotes a cover for covering the second frame 8. The cover 10 has an aperture 11 at a central portion thereof through which the front portion of the male connector 1 is protruded. The size of the aperture 11 is relatively larger than that of the front portion of the male connector 1. On the inner side of the cover 10, there are formed four bosses 12 which are arranged so as to correspond to the screw holes of the tabs 9 of the second frame 8, respectively. Further, on the opposite sides of the cover 10, there are provided tabs 13 for mounting the connector device to a body of a vehicle or the like.

When the connector device of the present invention is assembled, first the flange member 3 with male connector 1 is fitted to the first frame 5 by engaging the protrusions 4 of the flange member 3 with the recesses 6*a* of the first flame 5. Next, thus assembled first frame 5 is fitted to the second flame 8 by engaging the protrusions 4' of the first frame 5 with the recesses 6*b* of the second frame 8. Thereafter, thus assembled second frame is attached to the cover 10 by screwing screws 14 through the screw holes of the tab 9 into the bosses 12 of the cover 10. Then, the front portion of the male connector 1 is protruded from the aperture 11 of the cover 10. Thus assembled connector device with a fitting adjustment mechanism is mounted to an inside of a dashboard of a vehicle or the like by bolts (not shown) passing a screw hole of each tab 13 of the cover 10.

As clearly shown in FIG. 2, the flange member 3 is positioned with respect to the first frame 5 by engaging the protrusions 4 of the flange member 3 with the recesses 6a of the first frame 5. In this case, as stated above, each of the protrusions 4, 4' is engaged with each of recess 6a, 6b in such a manner that the protrusion 4, 4' is displaced to the adjacent recess 6a, 6b step-by-step when an external force is exerted to the male connector 1. Namely, the male connector 1 can be displaced with respect to the first frame along X direction in FIG. 1. Further, the first frame 5 can also be displaced with respect to the second frame 8 along Y direction in FIG. 1 which is perpendicular to the X direction. Therefore, the male connector 1 can be displaced with respect to the second frame 8 toward not only the X direction but also Y direction within a plane substantially perpendicular to the insertion direction of the male connector 1 to the female connector 19. This means that in this connector device the front portion of the male connector 1 can be displaced within the aperture 11 in all directions when assembled.

Figure 3:
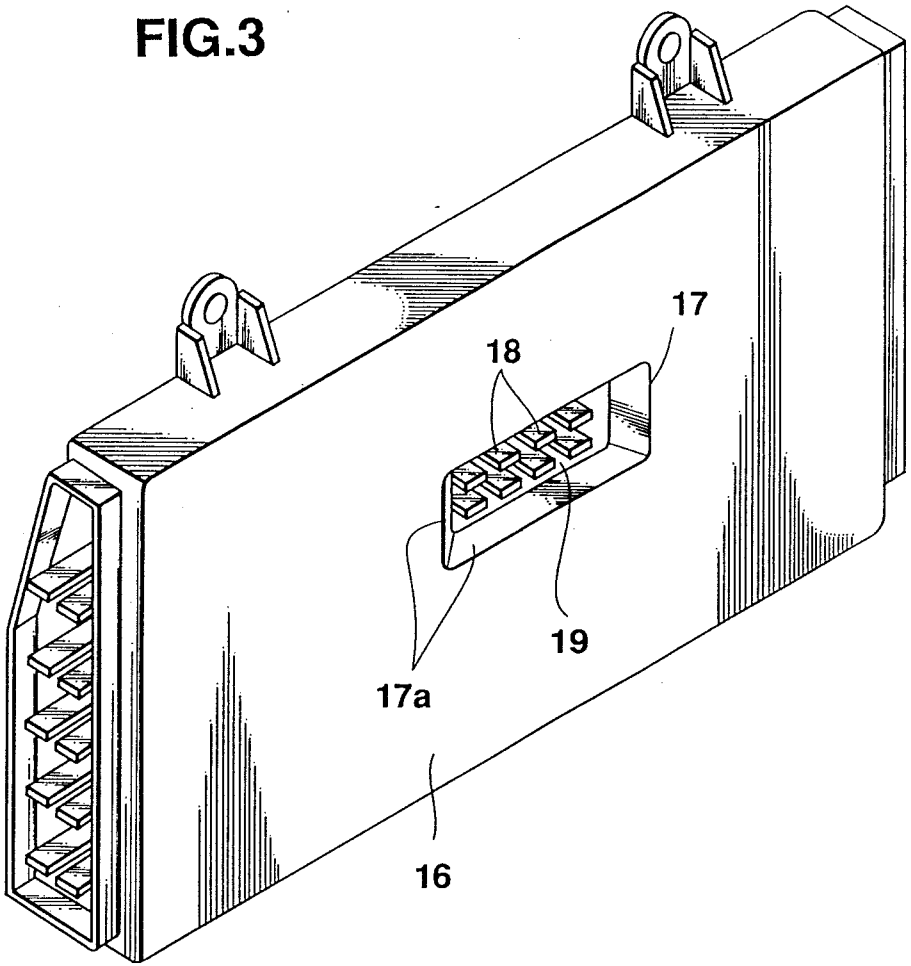
FIG. 3 is a perspective view of the partner connector to which the connector of this connector device is fitted.

According to the embodiment described above, the connector device assembled as stated above can be fitted to a female connector 19 as shown in FIG. 3. The female connector 19 is accommodated in an electrical junction box 16, and male terminals 18 to be fitted to the female terminals of the male connector 1 are exposed through an aperture 17 of a cover of the junction box 16. Around the aperture 17 of the junction box 16, there are formed tapered surfaces as shown in FIG. 3. Therefore, in a case where the male connector of the connector device of the embodiment is fitted to the female connector 19 in the junction box 16, even if there is a positional deviation between the male and female connectors 1 and 19, the positional deviation can be corrected since the front portion of the male connector 1 is guided along the tapered surfaces and then the male connector can be displaced step-by-step. Then, the male connector can keep its posture as it is since the male connector 1 is supported to the first and second frames 5 and 8 by the engagements of the protrusions and recesses.

In this embodiment, although the male connector is provided with the flange member around which the protrusions are provided, the protrusions can be formed on the outer periphery of the connector. Further, it is possible to provide protrusions on the inner surfaces of the first frame, recesses on the outer surfaces of the connector, protrusions on the inner surfaces of the second frame and recesses on the outer surfaces of the first frame.

It is to be understood that even though the present invention has been described in its preferred embodiments, many modifications and improvements may be defined by the apended claims.

What is claimed is:

1. A connector device with a mating adjustment mechanism, which comprises:

a connector adapted to mate with a mating connector;

a first frame which surrounds the connector;

a second frame which surrounds the first frame;

first means for enabling step-by-step displacement of the connector with respect to the first frame along an X or Y direction within a plane substantially perpendicular to the mating direction of the connectors; and second means for enabling step-by-step displacement of the first frame with respect to the second frame along the direction perpendicular to the displaceable direction of the connector with respect to the first frame within said plane.

2. The connector device as claimed in claim 1, wherein said first means is provided between the connector and the first frame and the second means is provided between the first and second frames.

3. The connector device as claimed in claim 2, wherein the connector has first and second opposite outer peripheral surfaces, and each of the first and second frames has a substantially rectangular shape having first and second opposite inner and outer peripheral surfaces, respectively; and wherein the first means comprises at least one first protrusion provided on each of the first opposite outer peripheral surfaces of the connector or each of the first opposite inner peripheral surfaces of the first frame which faces one of the outer peripheral surfaces of the connector, and a plurality of first recesses are provided on each of the first opposite inner surfaces of the first frame or each of the first opposite outer peripheral surfaces of the connector in such a manner that the at least one protrusion is engaged with one of the recesses; and wherein the second means comprises at least one second protrusion provided on each of the second opposite outer peripheral surfaces of the first frame or each of the second opposite inner peripheral surfaces of the second frame, and a plurality of second recesses are provided on each of the second opposite inner surfaces of the second frame or each of the second opposite outer surfaces of the first frame in such a manner that the at least one protrusion of the second means is engaged with one of the recesses on the second surfaces.

4. The connector device as claimed in claim 3, wherein the engagement between each at least one protrusion and the respective recess is set such that the protrusion can be displaced to an adjacent recess in a step-by-step manner when a predetermined external force is exerted on the connector.

5. The connector device as claimed in claim 4, wherein each at least one protrusion comprises two spaced protrusions.

6. The connector device as claimed in claim 5, wherein each protrusion has a substantially semi-circular shape in cross section, and the protrusion extends normal to the mating direction of the connectors, and each of the recesses also has a substantially semi-circular shape in cross section and also extends normal to the mating direction of the connectors.

7. The connector device as claimed in claim 3, wherein the connector further comprises a flange member having first and second opposite outer peripheral surfaces, and the at least one first protrusion or the first recesses is formed on the first opposite outer peripheral surfaces of the flange member.

8. The connector device as claimed in claim 7, wherein the connector has a front portion adapated to mate with a front portion of the mating connector, the connector device further comprises a cover having an aperture from which the front portion of the connector protrudes, and the cover is attached to the second frame.

9. The connector device as claimed in claim 8, wherein the connector is a male connector and the mating connector is a female connector, the female connector is accommodated in a case having an aperture through which the female connector is exposed, and the aperture has tapered edges for guiding the front portion of the male connector.

* * * * *